US009790942B2

(12) United States Patent
Tang et al.

(10) Patent No.: US 9,790,942 B2
(45) Date of Patent: Oct. 17, 2017

(54) LOW VIBRATION SCROLL COMPRESSOR FOR AIRCRAFT APPLICATION

(71) Applicant: HONEYWELL INTERNATIONAL INC., Morristown, NJ (US)

(72) Inventors: Benjamin Tang, Monterey Park, CA (US); Niall McCabe, Torrance, CA (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 177 days.

(21) Appl. No.: 14/832,185

(22) Filed: Aug. 21, 2015

(65) Prior Publication Data

US 2017/0051742 A1 Feb. 23, 2017

(51) Int. Cl.

| | |
|---|---|
| ***F04C 18/04*** | (2006.01) |
| ***F04C 29/00*** | (2006.01) |
| ***F04C 18/02*** | (2006.01) |

(52) U.S. Cl.

CPC ..... *F04C 29/0071* (2013.01); *F04C 18/0215* (2013.01); *F04C 18/0223* (2013.01); *F04C 29/0057* (2013.01); *F04C 2230/60* (2013.01); *F04C 2270/12* (2013.01)

(58) Field of Classification Search

CPC ..... F01C 21/003; F04C 2240/807
USPC ..... 418/1, 55.3, 57
See application file for complete search history.

(56) References Cited

U.S. PATENT DOCUMENTS 5,141,417 A * 8/1992 Bush ..... F01C 17/06 418/1
5,188,521 A * 2/1993 Kawahara ..... F04C 29/0021 418/151
5,281,114 A * 1/1994 Bush ..... F04C 18/0215 418/1
5,740,773 A * 4/1998 Ohshige ..... F01L 1/02 123/198 DA
6,494,695 B1 12/2002 Lifson (Continued)

FOREIGN PATENT DOCUMENTS

| | | | |
|---|---|---|---|
| EP | 2762727 | A1 | 8/2014 |
| JP | H05312157 | A | 11/1993 |
| WO | 2014091641 | A1 | 6/2014 |

OTHER PUBLICATIONS

Jeff J. Meter and Raymond L. Deblois, Counterweighting Scroll Compressor for Minimal Bearing Loads, Purdue University Purdue e-Pubs, 1988, United Technologies Research Center, East Hartford, CT.

(Continued)

*Primary Examiner* — Mark Laurenzi
*Assistant Examiner* — Anthony Ayala Delgado
(74) *Attorney, Agent, or Firm* — Shimokaji IP

(57) ABSTRACT

A scroll compressor includes a fixed scroll; an orbiting scroll that interfaces the fixed scroll; an Oldham ring that interfaces the orbiting scroll and has a pre-unbalanced force profile; and a motor shaft that interfaces the Oldham ring. The Oldham ring pre-unbalanced force profile is in the form of a sine wave. One of the shaft and the orbiting scroll has an imbalance weight portion; wherein the imbalance weight portion provides a weighted force profile that is 180° opposite of the pre-unbalanced force profile of the Oldham ring and produces in the Oldham ring a post-unbalanced force profile that is substantially a flat line.

20 Claims, 6 Drawing Sheets

(56) References Cited

U.S. PATENT DOCUMENTS

| | | | |
|---|---|---|---|
| 7,455,508 | B2 | 11/2008 | Suefuji et al. |
| 7,967,581 | B2 | 6/2011 | Beagle et al. |
| 2006/0290305 | A1 | 12/2006 | Washino et al. |
| 2014/0178229 | A1 | 6/2014 | Bonnefoi et al. |
| 2015/0078945 | A1 | 3/2015 | Su et al. |

OTHER PUBLICATIONS

Search Report and Office Action from EP Application No. 216184772 dated Dec. 22, 2016.

* cited by examiner

LOW VIBRATION SCROLL COMPRESSOR FOR AIRCRAFT APPLICATION

BACKGROUND OF THE INVENTION

The present invention generally relates to scroll compressors and, more particularly, to apparatus and methods reducing vibration in scroll compressors.

To save weight, power consumption, and cabin heat load, large passenger airliners are using centralized vapor cycle systems to cool food, drink, and in some instances, avionic electronic components. To enable load matching with the large variation in heat load demand and variation of climates due to airport locations and fly altitudes, variable compressors with wide operating speed band are employed.

An Oldham ring is used to keep the orbiting scroll from rotating. The Oldham ring is in an oscillating motion, along a single axis, at the same frequency as the orbiting scroll motion and compressor motor rotation. The Oldham ring motion is unbalanced and produces an unbalance force that is a function of the square of the compressor speed. The unbalance force is in a sine wave form with a frequency equal to the compressor operating speed.

At high compressor speed, the Oldham ring unbalance force creates vibration force that can transmit into the aircraft structure and into the passenger cabin. The transmitted vibration can cause extra noise in the cabin environment and be a passenger comfort issue.

Methods to reduce vibration transmission include vibration isolators and vibration dampers. Wide compressor operating speed band reduces some of the effectiveness of isolators and dampers.

As can be seen, there is a need to minimize vibration from scroll compressors.

SUMMARY OF THE INVENTION

In one aspect of the present invention, a scroll compressor comprises a fixed scroll; an orbiting scroll that interfaces the fixed scroll; an Oldham ring that interfaces the orbiting scroll and has a pre-unbalanced force profile; a motor shaft that interfaces the Oldham ring; wherein one of the motor shaft and the orbiting scroll has an imbalance weight portion; wherein the imbalance weight portion: has a weighted force profile that is about 175° to about 185° opposite of the pre-unbalanced force profile of the Oldham ring; and produces in the Oldham ring a post-unbalanced force profile that is substantially a flat line.

In another aspect of the present invention, a scroll compressor comprises a fixed scroll; an orbiting scroll having a base portion, wherein the orbiting scroll interfaces the fixed scroll; an Oldham ring that interfaces the orbiting scroll and has a pre-unbalanced force profile in the form of a sine wave; a motor shaft having a plate portion, wherein the motor shaft interfaces the Oldham ring; wherein the plate portion of the motor shaft and the base portion of the orbiting scroll define an imbalance weight area; wherein the imbalance weight area includes an imbalance weight portion having a mass characterization that is equal to about 45% to about 55% of a mass of the Oldham ring; wherein the imbalance weight area converts the Oldham ring pre-unbalanced force profile to an Oldham ring post-unbalanced force profile that is in the form of a substantially flat line.

In yet another aspect of the present invention, a scroll compressor comprises a motor shaft having a plate portion; a fixed scroll that interfaces the shaft; an orbiting scroll having a base portion, wherein the orbiting scroll interfaces the fixed scroll; an Oldham ring that interfaces the orbiting scroll and has a pre-unbalanced force profile in the form of a sine wave; wherein the plate portion of the motor shaft and the base portion of the orbiting scroll define an imbalance weight area; wherein the imbalance weight area having a mass moment profile in the form of a sine wave that is about 175° to about 185° opposite of the sine wave of the pre-unbalanced force profile; wherein the imbalance weight area reduces an amplitude of the sine wave of the pre-unbalanced force profile by about 45% to about 55%.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

The present invention generally provides a scroll compressor with reduced Oldham ring imbalance force. A rotating imbalance is provided to a rotor shaft and/or orbiting scroll and/or swing link of the compressor. In one or more of the foregoing compressor components, the rotating imbalance can be an addition to or reduction of weight of the compressor component.

In general, the rotating imbalance of the present invention can be positioned on the compressor component that can produce a mass moment of about 175° to about 185° opposite of an Oldham ring pre-unbalanced force characteristic or profile that exists prior to the rotating imbalance affecting the pre-unbalanced force characteristic or profile.

The rotating imbalance of the present invention can reduce a magnitude of the Oldham ring pre-unbalanced force profile, such as by about 45% to about 55%.

The rotating imbalance of the present invention may, in general, change or convert the Oldham ring pre-unbalanced force profile in the form of a sine wave to an Oldham ring post-unbalanced force characteristic or profile in the form of a constant, flat line. The post-unbalanced force profile, when viewed in a direction perpendicular to the Oldham ring translation direction, is in the form of a sine wave.

Figure 1:
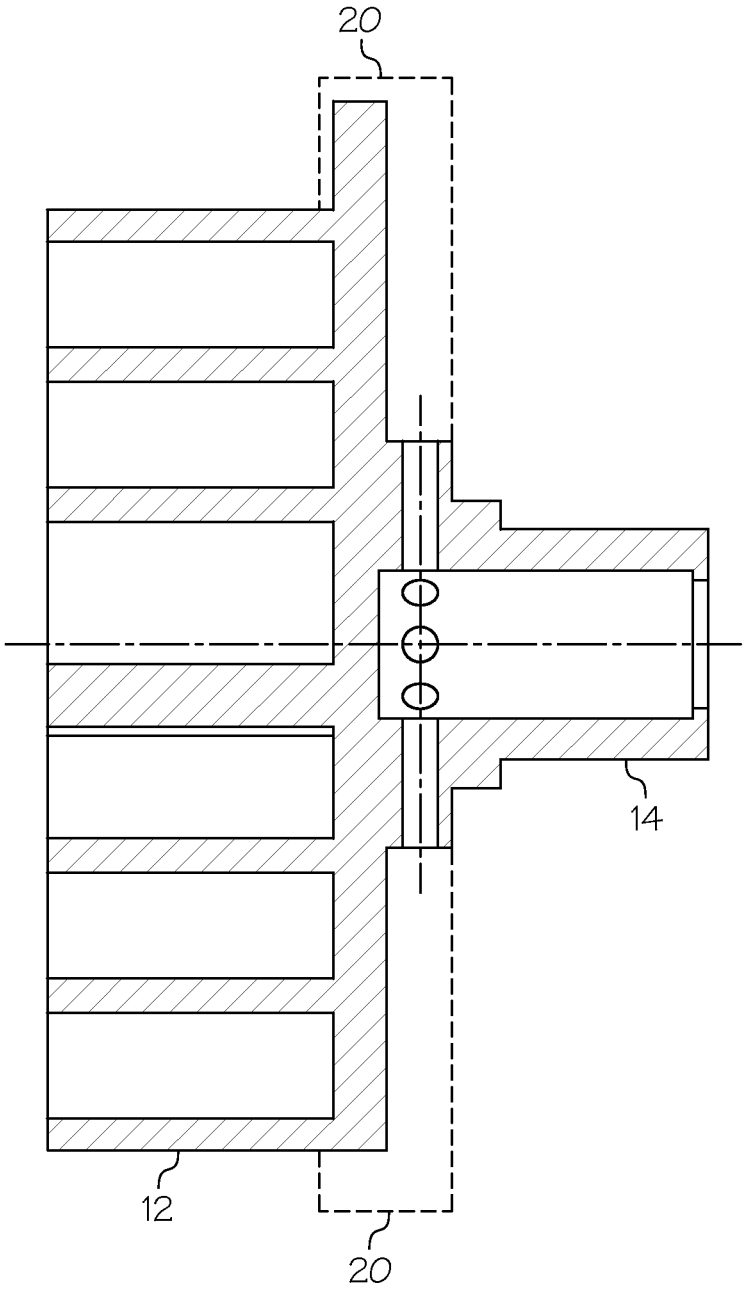
FIG. 1 is a cross-sectional diagram of a scroll compressor according to an exemplary embodiment of the present invention.

In FIG. 1, a scroll compressor 10 according to an exemplary embodiment is shown. The scroll compressor 10 may have, as primary compressor components, a fixed scroll 11, an orbiting scroll 12 that interfaces the fixed scroll 11, an Oldham ring 13 that interfaces the orbiting scroll 12, and a motor shaft 14 that interfaces the Oldham ring 13. Other components that are well known in the art can also be a part of the compressor 10.

As seen in FIG. 1, the compressor 10 may also have an imbalance weight area 20 having boundaries defined by a location of a base portion of the orbiting scroll 12 and by a location of a plate portion of the motor shaft 14, both of which are further described below. Within the imbalance weight area 20 can be one or more imbalance weight portions 20*a* in one or more compressor components as further described below. However, in some embodiments, one or more of the imbalance weight portions 20*a* can be outside of the imbalance weight area 20.

The imbalance weight area 20 and imbalance weight portion 20*a* can have an imbalance mass characteristic. Herein, the term "imbalance mass characteristic" means, in the imbalance weight area 20 and/or portion 20*a*, an amount of mass that has been added to a compressor component or an amount of mass that has been removed or is absent from the compressor component. In some embodiments, the imbalance mass characteristic can be a mass equal to from about 45% to about 55% of the mass of the Oldham ring 13. In other embodiments, the mass can be equal to 50% of the mass of the Oldham ring 13.

Additionally, or alternatively, the term "imbalance mass characteristic" means, in the imbalance weight area 20 and/or portion 20*a*, an added mass or absent mass at a position that is representative of about 175° to about 185°, or at about 180°, from an apex of a sine wave that describes a pre-unbalanced force characteristic of the Oldham ring 13 as described below.

Additionally, or alternatively, the term "imbalance mass characteristic" means a mass moment of a compressor component that can be equal to a percentage (such as 45% to 55%, or 50%) of the mass of the Oldham ring 13 times an orbiting radius of the orbiting scroll 12. Or, mass moment can be equal to a percentage of the mass of the Oldham ring 13 times half of a translation length of the Oldham ring.

The imbalance weight area 20 and/or imbalance weight portion(s) can, in certain embodiments, reduce a pre-unbalanced force magnitude of the Oldham ring 13 by about 45% to about 55%, or about 50%.

Figure 2:
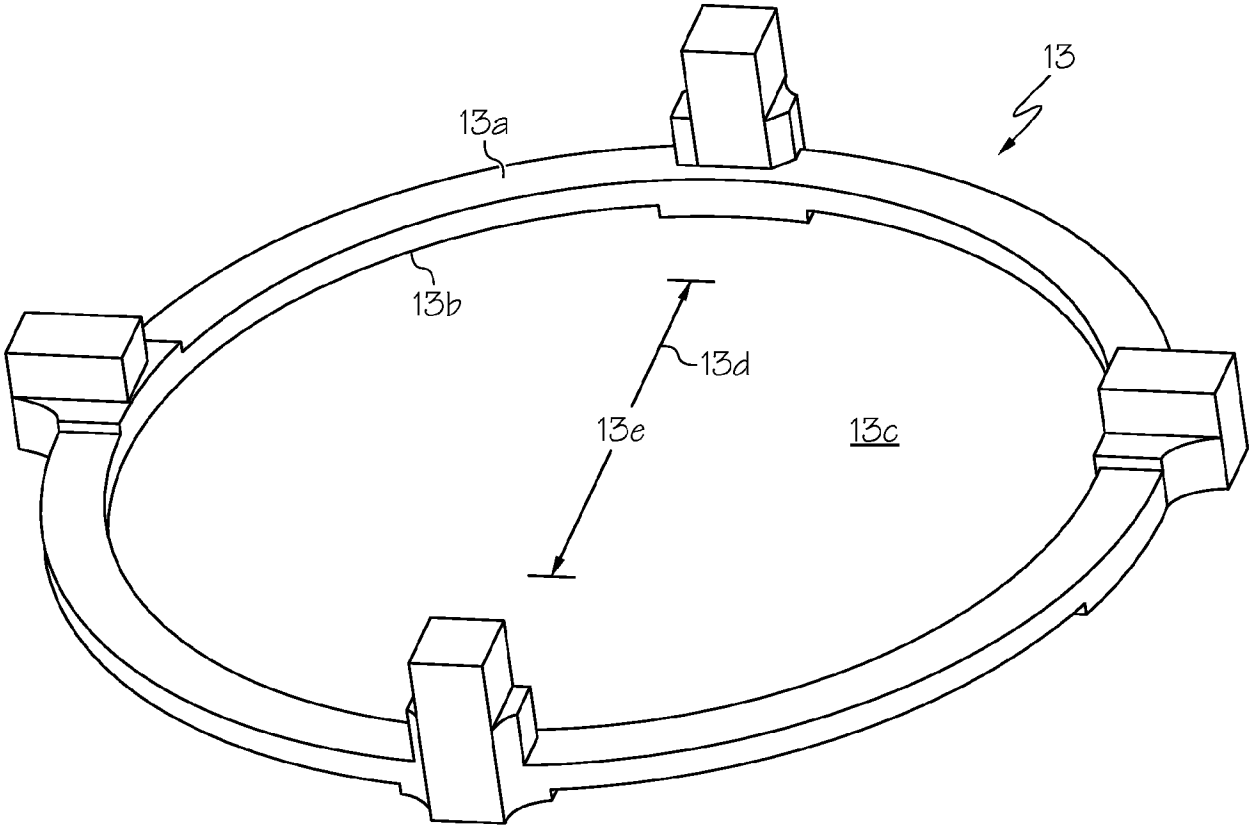
FIG. 2 is a perspective view of an Oldham ring of a scroll compressor according to an exemplary embodiment of the present invention.

FIG. 2 depicts the Oldham ring 13, according to an exemplary embodiment, with a first planar surface 13*a* and an opposed second planar surface 13*b*. As is known, as the orbiting scroll rotates, the Oldham ring 13 can translate back and forth in a translation plane 13*c* and along an axis 13*d* in the translation plane 13*c*. The amount of translation can be defined by a translation length 13*e*. The translation of the Oldham ring 13 can produce a pre-unbalanced force. The pre-unbalanced force may have a pre-unbalanced force characteristic or profile.

Figure 3:
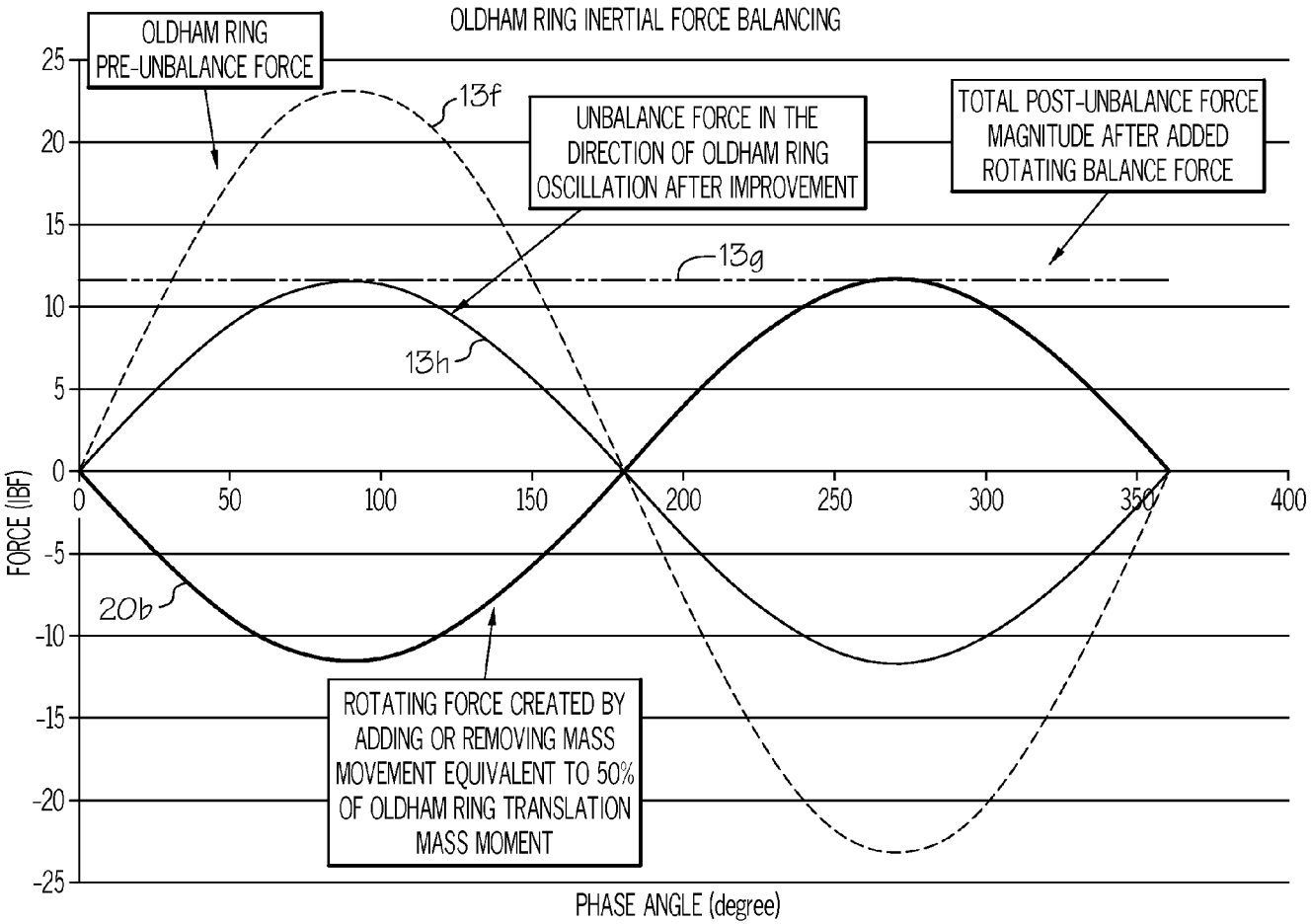
FIG. 3 is a graph depicting an pre-unbalanced force and a post-unbalanced force of an Oldham ring according to an exemplary embodiment of the present invention.

FIG. 3 is a graph depicting the pre-unbalanced force profile 13*f* of the Oldham ring 13. The term "pre-unbalanced force profile" means the characteristics or profile of the force that would otherwise be produced by the Oldham ring 13 in the absence of an imbalance weight portion(s) 20*a*. With the addition of the imbalance weight portions(s) 20*a*, the combined Oldham ring 13 and imbalance weight portion(s) 20*a* have a post-unbalanced force profile 13*g*. The term "post-unbalanced force profile" means the characteristics or profile of the force produced by the Oldham ring 13 and the imbalance weight portions(s) 20*a*.

As seen in FIG. 3, the pre-unbalanced force profile 13*f* of the Oldham ring 13 can be generally in the form of a sine wave representative of an oscillating force magnitude. The profile 13*f* has a maximum amplitude at an apex of the sine wave that is representative of a maximum force magnitude produced by the Oldham ring 13 in the absence of the imbalance weight portions(s) 20*a*. As further described below, the imbalance weight portion(s) 20*a* can convert the pre-unbalanced force profile 13*f* to a post-unbalanced force profile 13*g* of the Oldham ring 13 that is a substantially flat line representative of a constant, non-oscillating force magnitude.

Figure 4:
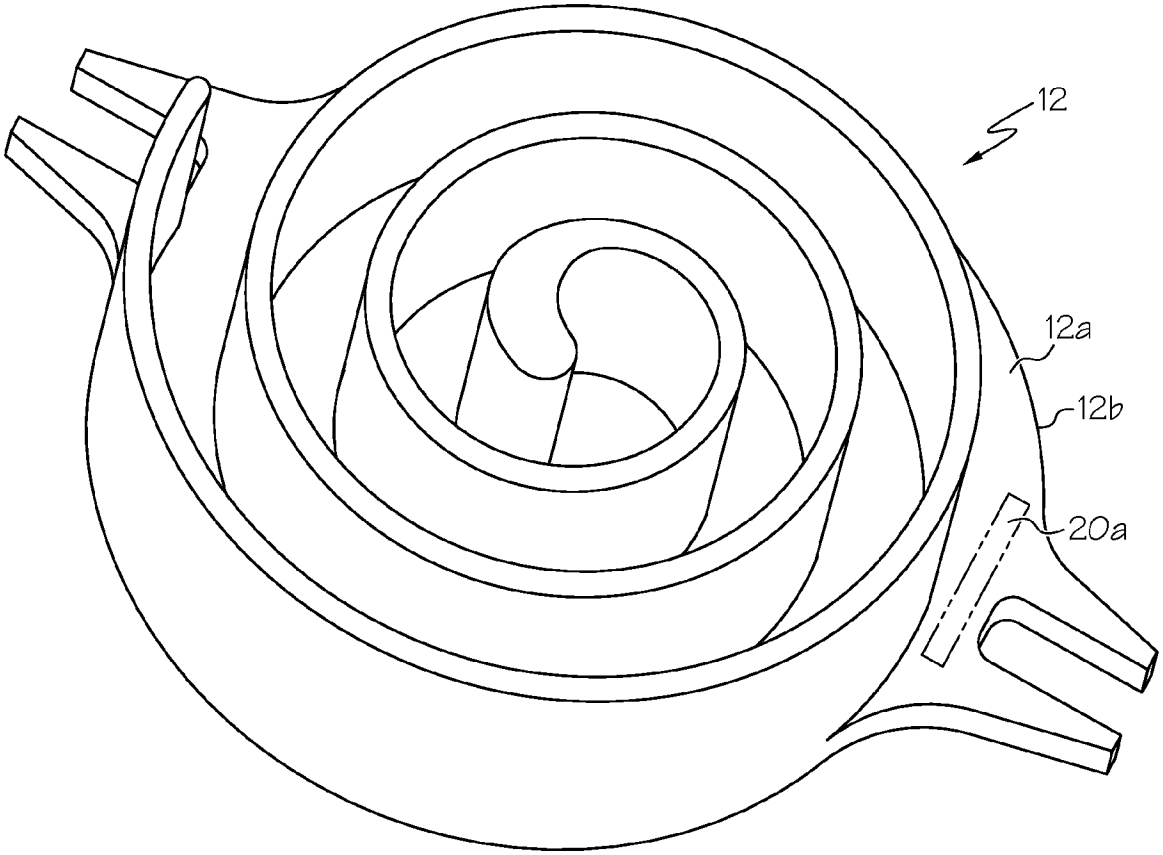
FIG. 4 is a perspective view of an orbiting scroll of a scroll compressor according to an exemplary embodiment of the present invention

FIG. 4 depicts the orbiting scroll 12, according to an exemplary embodiment, with a base portion 12*a* having a planar face 12*b* that interfaces the first planar surface 13*a* of the Oldham ring 13. As is known, the orbiting scroll 12 can orbit about an orbiting diameter having an orbiting radius 12*c* (FIG. 5A). The orbiting diameter can be equal to the Oldham ring translation length 13*e*.

The orbiting scroll 12 can have an imbalance weight portion(s) 20*a* which, in some embodiments, is located in the base portion 12*a* and in the form of a surface indentation or surface irregularity where mass is absent. In other embodiments, the imbalance weight portion 20*a* can be a reduced thickness of the base portion 12*a*. In further embodiments, the imbalance weight portion 20*a* can be located in places of the orbiting scroll 12 other than in the base portion 12*a*. Whether in the base portion 12*a* or otherwise, the position of the imbalance weight portion 20*a* can be equivalent to a position that is from about 175° to about 185°, or at about 180°, from the apex of the sine wave that describes the pre-unbalanced force of the Oldham ring 13 described above.

The imbalance mass characteristics of the imbalance weight portion(s) 20*a* of the orbiting scroll 12 can be seen in FIG. 3. The imbalance weight portion(s) produces in the scroll 12 a rotating force having a weighted or rotating force characteristic or profile 20*b* generally in the form of a sine wave. The weighted or rotating force profile 20*b* is opposite to the pre-unbalanced force profile 13*f* of the Oldham ring 13. In embodiments, the profile 20*b* is from about 175° to about 185°, or about 180°, opposite to the profile 13*f*. Thus, the rotating force of the scroll 12 is about 175° to about 185°, or about 180°, opposite to the pre-unbalanced force of the Oldham ring 13.

The opposite direction of the rotating force of the scroll 12 converts or changes the pre-unbalanced force of the Oldham ring 13 to a post-unbalanced force of the Oldham ring 13. The post-unbalanced force has a post-unbalanced force characteristic or profile in the form of a substantially flat line 13*g*. When viewed along the translation axis 13*d*, the post-unbalanced force characteristic or profile is generally in the form of a sine wave 13*h*.

As shown in FIG. 3, the imbalance weight portion(s) in the scroll 12 can reduce, in certain embodiments, a pre-unbalanced force magnitude in the Oldham ring 13 by about 45% to about 55%, or about 50%.

Figure 5B:
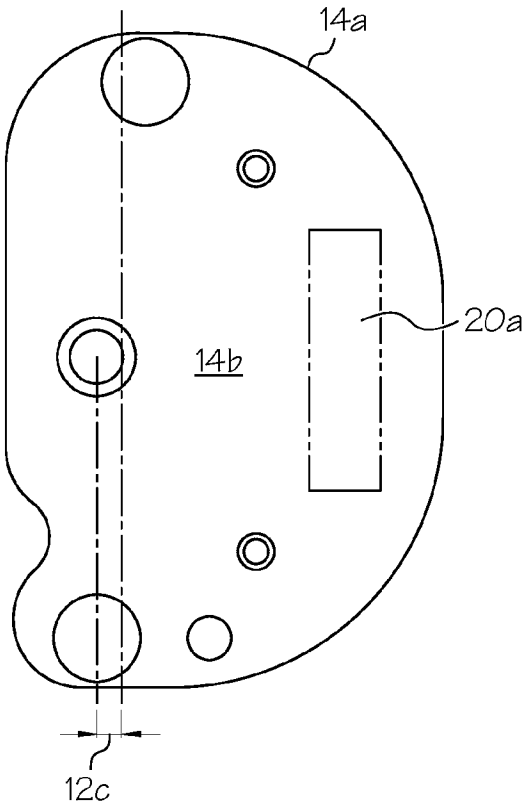
FIG. 5B is a top diagrammatic view of a motor shaft of a scroll compressor according to an exemplary embodiment of the present invention
Figure 5A:
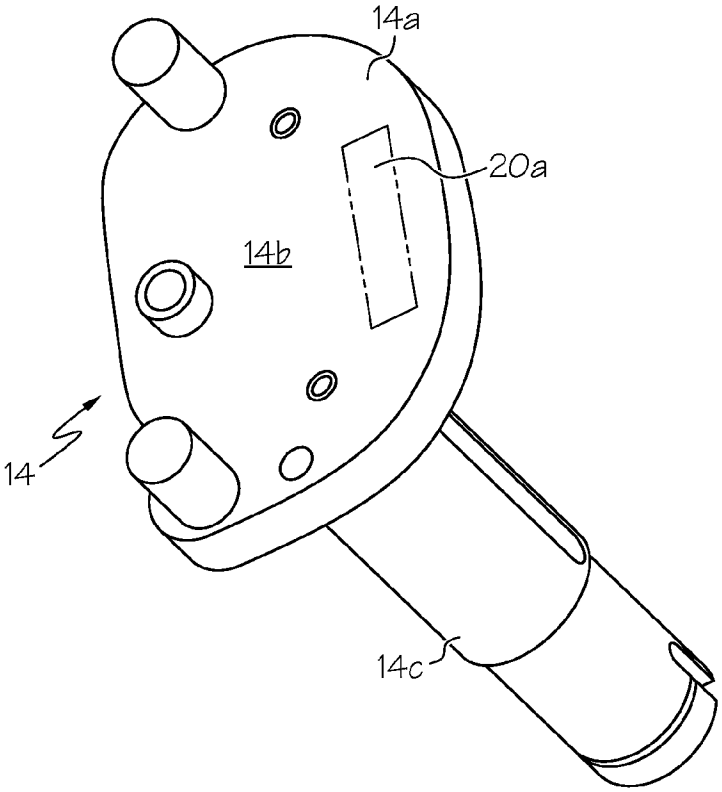
FIG. 5A is a perspective view of a motor shaft of a scroll compressor according to an exemplary embodiment of the present invention.

FIGS. 5A-5B depict the motor shaft 14, according to an exemplary embodiment, with a plate portion 14*a* having a planar face 14*b*. The planar face 14*b* may interface the second planar surface 13*b* of the Oldham ring 13. The motor shaft 14 may further have shaft portion 14*c* that extends from the plate portion 14*a*.

In embodiments, the motor shaft 14 may have an imbalance weight portion(s) 20*a* which, in some embodiments, is located in the plate portion 14*a* where mass is added. In other embodiments, the imbalance weight portion 20*a* can be an increased thickness of the plate portion 14*a*. In further embodiments, the imbalance weight portion 20*a* can be located in places other than in the plate portion 14*a*, such as in the shaft portion 14*c*. Whether in the plate portion 14*a* or otherwise, the position of the imbalance weight portion 20*a* can be equivalent to a position that is from about 175° to about 185°, or at about 180°, from the apex of the sine wave that describes the pre-unbalanced force of the Oldham ring 13.

The imbalance mass characteristics of the imbalance weight portion(s) 20*a* of the motor shaft 14 can be seen in FIG. 3. The imbalance weight portion(s) produces in the motor shaft 14 a weighted or rotating force having a weighted or rotating force characteristic or profile 20*b* generally in the form of a sine wave. The weighted or rotating force profile 20*b* is opposite to the pre-unbalanced force profile 13*f* of the Oldham ring 13. In embodiments, the profile 20*b* is from about 175° to about 185°, or about 180°, opposite to the profile 13*f*. Thus, the rotating force of the motor shaft 14 is about 175° to about 185°, or about 180°, opposite to the pre-unbalanced force of the Oldham ring 13.

The opposite direction of the rotating force of the motor shaft 14 converts or changes the pre-unbalanced force of the Oldham ring 13 to a post-unbalanced force of the Oldham ring 13. The net post-unbalanced force has a post-unbalanced force characteristic or profile in the form of a substantially flat line 13*g*. When viewed along the translation axis 13*d*, the post-unbalanced force characteristic profile is generally in the form of a sine wave 13*h*.

Figure 6:
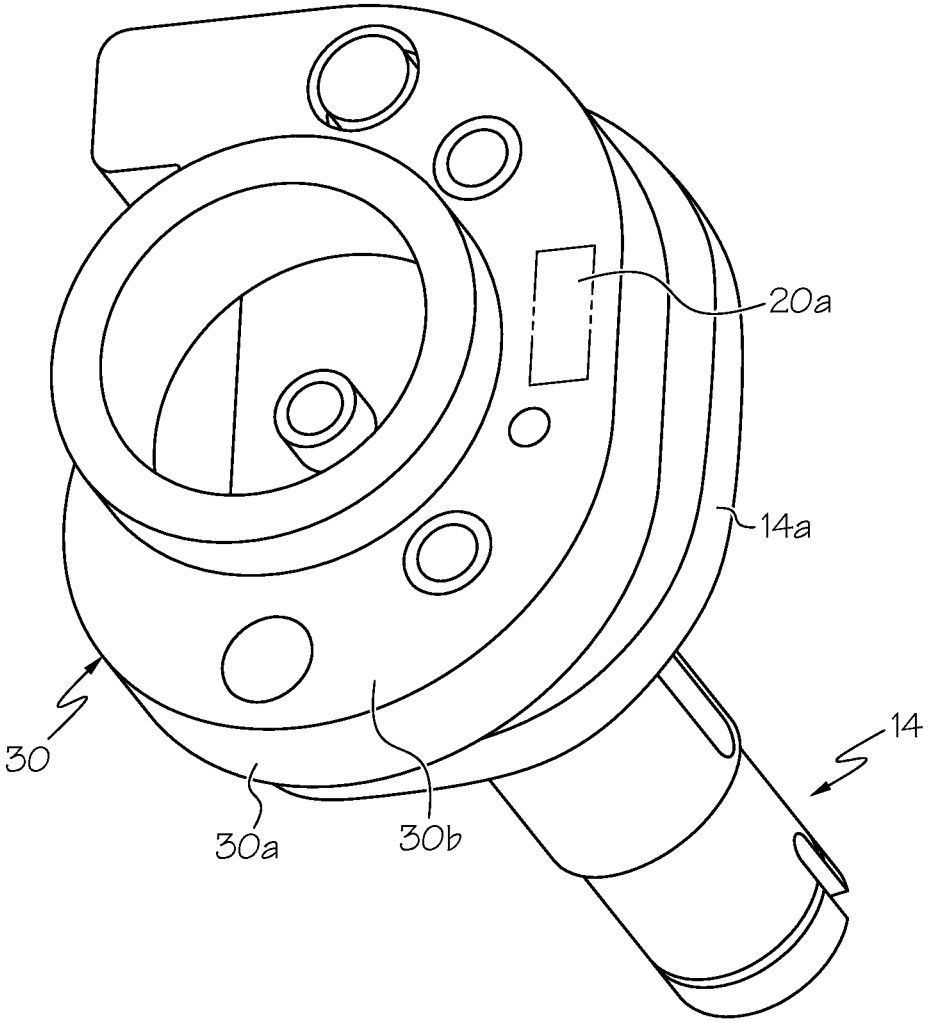
FIG. 6 is a perspective view of a swing link of a scroll compressor according to an exemplary embodiment of the present invention.

FIG. 6 depicts a swing link 30 on the motor shaft 14, according to an exemplary embodiment. The swing link 30 can support the Oldham ring 13 (not shown). The swing link 30 can have a plate portion 30*a* having a planar face 30*b*. The planar face 30*b* may interface the second planar surface 13*b* of the Oldham ring 13.

In embodiments, the swing link 30 may have an imbalance weight portion(s) 20*a* which, in some embodiments, is located in the plate portion 30*a* where mass is added. In other embodiments, the imbalance weight portion 20*a* can be an increased thickness of the plate portion 30*a*. Whether in the plate portion 30*a* or otherwise, the position of the imbalance weight portion 20*a* can be equivalent to a position that is from about 175° to about 185°, or at about 180°, from the apex of the sine wave that describes the pre-unbalanced force of the Oldham ring 13.

The imbalance mass characteristics of the imbalance weight portion(s) 20*a* of the swing link 30 can be seen in FIG. 3. The imbalance weight portion(s) produces in the swing link 30 a weighted or rotating force having a weighted or rotating force characteristic or profile 20*b* generally in the form of a sine wave. The weighted or rotating force profile 20*b* is opposite to the pre-unbalanced force profile 13*f* of the Oldham ring 13. In embodiments, the profile 20*b* is from about 175° to about 185°, or about 180°, opposite to the profile 13*f*. Thus, the rotating force of the swing link 30 is about 175° to about 185°, or about 180°, opposite to the pre-unbalanced force of the Oldham ring 13.

The opposite direction of the rotating force of the swing link 30 converts or changes the pre-unbalanced force of the Oldham ring 13 to a post-unbalanced force of the Oldham ring 13. The net post-unbalanced force has a post-unbalanced force characteristic or profile in the form of a substantially flat line 13*g*. When viewed along the translation axis 13*d*, the post-unbalanced force characteristic profile is generally in the form of a sine wave 13*h*.

It should be understood, of course, that the foregoing relates to exemplary embodiments of the invention and that modifications may be made without departing from the spirit and scope of the invention as set forth in the following claims.

We claim:

1. A scroll compressor, comprising:
a fixed scroll;
an orbiting scroll that interfaces the fixed scroll;
an Oldham ring that interfaces the orbiting scroll and has a pre-unbalanced force profile;
a motor shaft that interfaces the Oldham ring;
wherein one of the motor shaft and the orbiting scroll has an imbalance weight portion;
wherein the imbalance weight portion:
has a weighted force profile that is about 175° to about 185° opposite of the pre-unbalanced force profile of the Oldham ring; and
produces in the Oldham ring a post-unbalanced force profile that is substantially a flat line.

2. The compressor according to claim 1, further comprising a swing link that is intermediate the motor shaft and Oldham ring; and
wherein one of the motor shaft, the orbiting scroll, and the swing link has the imbalance weight portion.

3. The compressor according to claim 1, further comprising a second imbalance weight portion in one of the orbiting scroll and the motor shaft.

4. The compressor according to claim 1, wherein the orbiting scroll includes a base portion; and
wherein the imbalance weight portion is in the base portion.

5. The compressor according to claim 3, wherein the imbalance weight portion is one of a reduced thickness and a surface irregularity of the base portion.

6. The compressor according to claim 1, wherein the orbiting scroll includes a base portion; and
wherein the imbalance weight portion is in a part of the orbiting scroll other than in the base portion.

7. The compressor according to claim 1, wherein the pre-unbalanced force profile of the Oldham ring is a sine wave.

8. A scroll compressor, comprising:
a fixed scroll;
an orbiting scroll having a base portion, wherein the orbiting scroll interfaces the fixed scroll;
an Oldham ring that interfaces the orbiting scroll and has a pre-unbalanced force profile in the form of a sine wave;
a motor shaft having a plate portion, wherein the motor shaft interfaces the Oldham ring;
wherein the plate portion of the motor shaft and the base portion of the orbiting scroll define boundaries of an imbalance weight area;

wherein the imbalance weight area includes an imbalance weight portion having a mass characterization that is equal to about 45% to about 55% of a mass of the Oldham ring;

wherein the imbalance weight area converts the Oldham ring pre-unbalanced force profile to an Oldham ring post-unbalanced force profile that is in the form of a substantially flat line.

9. The compressor according to claim 8, wherein the imbalance weight portion is in the base portion of the orbiting scroll.

10. The compressor according to claim 8, wherein the imbalance weight portion is in an area of the orbiting scroll other than in the base portion.

11. The compressor according to claim 8, wherein the imbalance weight portion is in the plate portion of the motor shaft.

12. The compressor according to claim 8, wherein the imbalance weight portion is in an area of the motor shaft other than in the plate portion.

13. The compressor according to claim 8, further comprising a plurality of imbalance weight portions in the imbalance weight area.

14. The compressor according to claim 8, further comprising a swing link in the imbalance weight area, and wherein the imbalance weight portion is in one of the orbiting scroll, the motor shaft, and the swing link.

15. The compressor according to claim 8, wherein the imbalance weight portion has a weighted force profile that is a sine wave.

16. The compressor according to claim 8, wherein a weighted force profile of the imbalance weight portion is opposite to the Oldham ring pre-unbalanced force profile.

17. A scroll compressor, comprising:

a motor shaft having a plate portion;

a fixed scroll that interfaces the shaft;

an orbiting scroll having a base portion, wherein the orbiting scroll interfaces the fixed scroll;

an Oldham ring that interfaces the orbiting scroll and has a pre-unbalanced force profile in the form of a sine wave;

wherein the plate portion of the motor shaft and the base portion of the orbiting scroll define boundaries of an imbalance weight area;

wherein the imbalance weight area has a mass moment profile in the form of a sine wave that is about 175° to about 185° opposite of the sine wave of the pre-unbalanced force profile;

wherein the imbalance weight area reduces an amplitude of the sine wave of the pre-unbalanced force profile by about 45% to about 55%.

18. The compressor according to claim 17, wherein the mass moment profile is 180° opposite of the pre-unbalanced force profile.

19. The compressor according to claim 17, wherein the imbalance weight area reduces the pre-unbalanced force profile by 50%.

20. The compressor according to claim 17, wherein the imbalance weight area produces a post-unbalanced force profile in the Oldham ring that is a flat line.

* * * * *